United States Patent [19]

Badiali

[11] Patent Number: 4,643,052

[45] Date of Patent: Feb. 17, 1987

[54] BEVEL GEAR DRIVEN OFFSET SCREWDRIVER ARRANGEMENT

[75] Inventor: John A. Badiali, Brockton, Mass.

[73] Assignee: Custom Spec Engineering, Inc., Brockton, Mass.

[21] Appl. No.: 714,432

[22] Filed: Mar. 21, 1985

[51] Int. Cl.[4] ..... B25B 17/00

[52] U.S. Cl. ..... 81/57.28; 81/438; 81/125; 16/DIG. 24

[58] Field of Search ..... 81/57.12, 57.13, 57.28, 81/57.29, 57.45, 438, 125; 16/DIG. 24–DIG. 25

[56] References Cited

U.S. PATENT DOCUMENTS

| | | | |
|---|---|---|---|
| 1,333,532 | 3/1920 | Berk | 81/57.29 |
| 1,352,354 | 9/1920 | Church | 81/57.28 X |
| 1,494,200 | 5/1924 | Waters | 81/57.29 |
| 2,550,775 | 5/1951 | Clark | 81/438 |
| 3,742,533 | 7/1973 | Brunette | 81/438 X |
| 4,448,095 | 5/1984 | Blodgette et al. | 81/57.29 |
| 4,524,649 | 6/1985 | Diaz et al. | 81/57.13 |

*Primary Examiner*—Roscoe V. Parker
*Assistant Examiner*—Debra S. Meislin
*Attorney, Agent, or Firm*—Kirschstein, Kirschstein, Ottinger & Israel

[57] ABSTRACT

A bevel gear driven offset screwdriver arrangement includes a housing which bounds an elongated passage and an opening which communicates with the passage and is centered on an axis that includes an obtuse angle of substantially between 100° and 135°, preferably 105°, with the axis of the passage. A shaft is rotatably received in the passage and carries at its end close to the opening a first bevel gear which meshes with a second bevel gear that is rotatably received in the opening. The housing is constituted by two separate half-shell sections which are held together by two holding rings that are slid onto semi-tubular regions of such sections and urge the latter together, as well as by screws. The second bevel gear has a central recess of a non-circular cross-sectional configuration, and a compatibly configurated support portion of a bit element is received in this recess and entrained for joint turning with the second gear element. A magnetic element accommodated in the housing cooperates with the support portion of the bit element, which is of a magnetically attractable material, to hold the support portion in the central recess against falling out of it in the axial direction. The magnetic element simultaneously serves as a thrust bearing for the bit element during the use of the arrangement.

5 Claims, 7 Drawing Figures

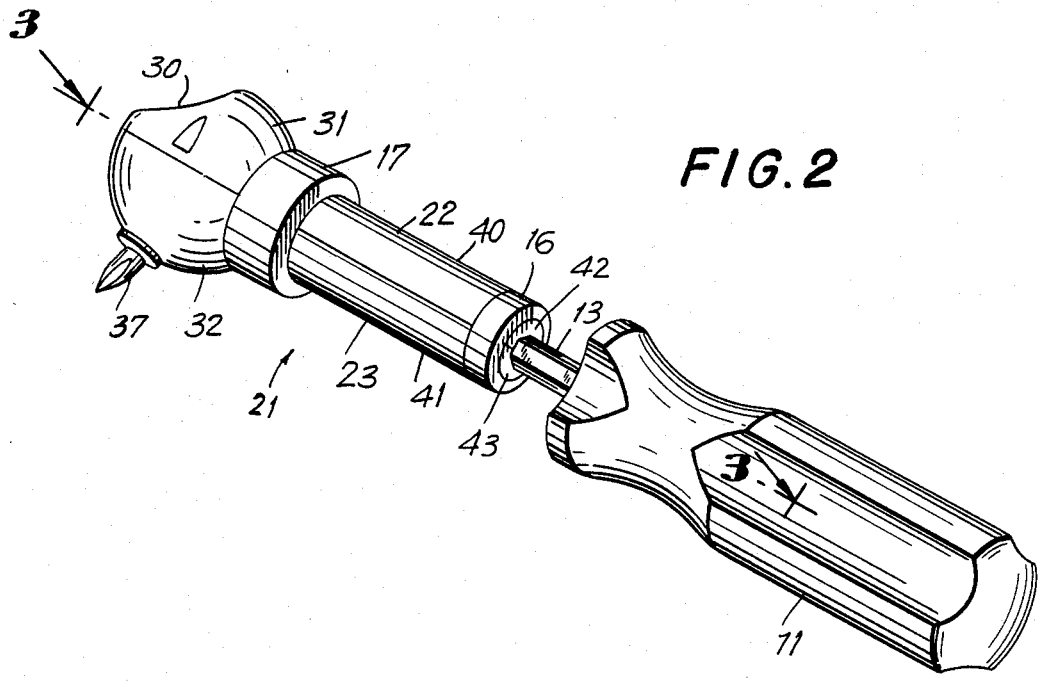
FIG. 2
FIG. 3
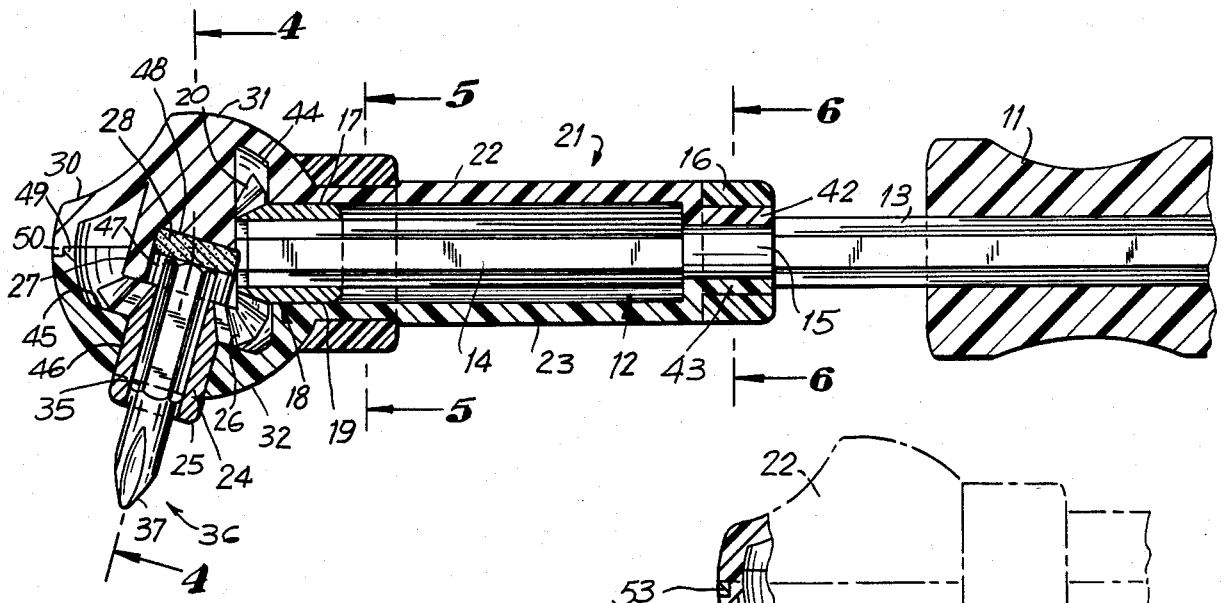
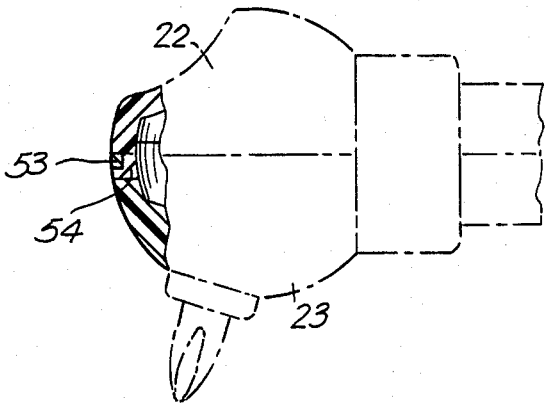
FIG. 7

BEVEL GEAR DRIVEN OFFSET SCREWDRIVER ARRANGEMENT

CROSS-REFERENCE TO RELATED DOCUMENT

The present invention was described in Disclosure Document No. 130,268 filed Aug. 23, 1984 in the U.S. Patent and Trademark Office.

BACKGROUND OF THE INVENTION

The present invention relates to tools in general and, more particularly, to hand-held, manually operated tools constructed to engage and tighten or loosen screws and other threaded elements.

There are already known various constructions of the arrangements of the type under consideration, starting with the simplest case of one-purpose tools and terminating with tools which have interchangeable bits so as to be able to cooperate with threaded elements of different configurations of the engaging portions. Examples of tools of the last-mentioned category may be found, for instance, in U.S. Pat. Nos. 933,639; 1,325,407; 2,042,376; 2,194,062; 2,607,252; 2,629,278; 2,664,020; 3,214,992; 3,696,694; 4,034,574 and 4,242,931. However, experience with these known arrangements has shown that they suffer from many disadvantages, such as unwieldiness, incapability to reach into or operate in hard-to-access places, complexity accompanied by excess expense, or the like. These drawbacks have hampered, if not prevented, acceptance of tools of the so-called bevel gear driven offset type in the marketplace. Of course, this is very disadvantageous, since the average consumer cannot or will not afford the purchase of the expensive equipment, and thus will not be able to enjoy the ease of handling afforded by the tools of this kind.

SUMMARY OF THE INVENTION

Accordingly, it is a general object of the present invention to avoid the disadvantages of the prior art.

More particularly, it is an object of the present invention to provide a bevel gear driven offset screwdriver arrangement which does not possess the disadvantages of the conventional arrangements of this type.

Still another object of the present invention is so to construct the arrangement of the type here under consideration as to be easy to handle, able to be used in places with difficult access thereto, and yet very sturdy despite its lack of complexity.

A concomitant object of the present invention is so to design the arrangement of the above type as to be simple in construction, inexpensive to manufacture, easy to use, and reliable in operation nevertheless.

In pursuance of these objects and others which will become apparent hereafter, one feature of the present invention resides in a screwdriver arrangement comprising a housing bounding an internal space including an elongated passage centered on a first axis and an opening that communicates with the passage and is centered on a second axis that includes an obtuse angle of between substantially 100° and 135° with the first axis; a shaft extending through the passage and mounted on the housing for rotation about the first axis; a first bevel gear mounted on the shaft for rotation about the first axis therewith at a region close to the opening; a second bevel gear mounted in the opening for rotation about the second axis and meshing with the first bevel gear in the internal space of the housing, the second bevel gear having a coaxial central recess of a non-circular cross-sectional configuration; and a bit element having a bit portion of a predetermined configuration compatible with that of a threaded element to be manipulated and a support portion of a cross-sectional configuration compatible with that of the recess of the second bevel gear for the support portion to be received in the latter and entrained for joint rotation with the second bevel gear during the operation of the arrangement in response to the rotation of the first bevel gear with the shaft. A particular advantage of the arrangement as described so far is that, because of the use of the obtuse angle between the first and second axes, the threaded element can be much more easily accessed and rotated than if the two axes included a right angle. In this context, it was established that best results are obtained when the obtuse angle is substantially 105°.

It is further advantageous according to another facet of the present invention when the housing includes two separate half-shell elements or sections including semi-tubular sections surrounding the passage in the assembled condition of the housing, there being further provided means for holding the half-shell elements together in the assembled condition, such holding means including at least one holding ring internally dimensioned for sliding onto and off the semi-tubular sections in the assembled condition against frictional forces and urging the half-shell elements toward one another upon being slid onto the semi-tubular sections. This provides for a very simple assembly and disassembly of the arrangement when needed, and yet for an excellent holding action. In this connection, it is particularly advantageous when there is provided another holding ring internally dimensioned in the same manner as the one holding ring and positioned axially spaced from the latter in the assembled condition. This further improves the holding action. Advantageously, the semi-tubular sections have regions of different outer radii, such regions and the holding rings being so dimensioned with respect to one another that the other holding ring is axially introducible into the holding ring to be accommodated therein at least after the one holding ring and the other snap ring have been slid off of the semi-tubular sections of the housing.

According to another concept of the present invention, at least the support portion of the bit element is of a magnetically attractable material. In this case, there is further provided means for retaining the support portion in the central recess of the other bevel gear against falling out of the latter during periods of non-use of the arrangement, such retaining means including a permanent magnet mounted in the housing in alignment with the second gear and attracting the support portion of the bit element with a magnetic force that is sufficient to keep the support portion in the central recess until overcome by the user of the arrangement during disassembly of the bit element from the remainder of the arrangement.

The present invention also relates to a screwdriver arrangement comprising a driving element centered on an axis and turnable about the latter, including a coaxial non-circular recess therein which opens onto an end face; a driven bit element having a support portion of a cross-sectional configuration compatible with that of the recess to be introducible into the latter and entrained for joint turning with the driving element, at least the support portion being of a magnetically attractable material; and means for holding the support portion in the recess against accidental falling out of the same in the axial direction during the period of non-use of the arrangement, including a magnetic element arranged at the recess and exerting a magnetic force on the support portion to attract the same and thus keep it in the recess until such force is deliberately overcome by a countervailing force exerted by the user.

The novel features which are considered as characteristic of the invention are set forth in particular in the appended claims. The improved screwdriver arrangement itself, however, both as to its construction and its mode of operation, together with additional features and advantages thereof, will be best understood upon perusal of the following detailed description of certain specific emodiments with reference to the accompanying drawing.

BRIEF DESCRIPTION OF THE DRAWING

FIG. 2 is a perspective view of the gear driven offset screwdriver of FIG. 1 in its assembled condition and at a scale showing the same substantially in actual dimensions;

FIG. 3 is an axial sectional view through a part of the gear driven offset screwdriver in the assembled condition, taken on line 3—3 of FIG. 2 but at a scale approximating that of FIG. 1;

FIG. 7 is a partially sectioned view of a fragment of the gear driven offset screwdriver taken in a plane corresponding to that of FIG. 3 but showing a modified construction of a detail of the screwdriver.

DETAILED DESCRIPTION OF THE PREFERRED EMBODIMENTS

Figures 1, 4, 5, 6:
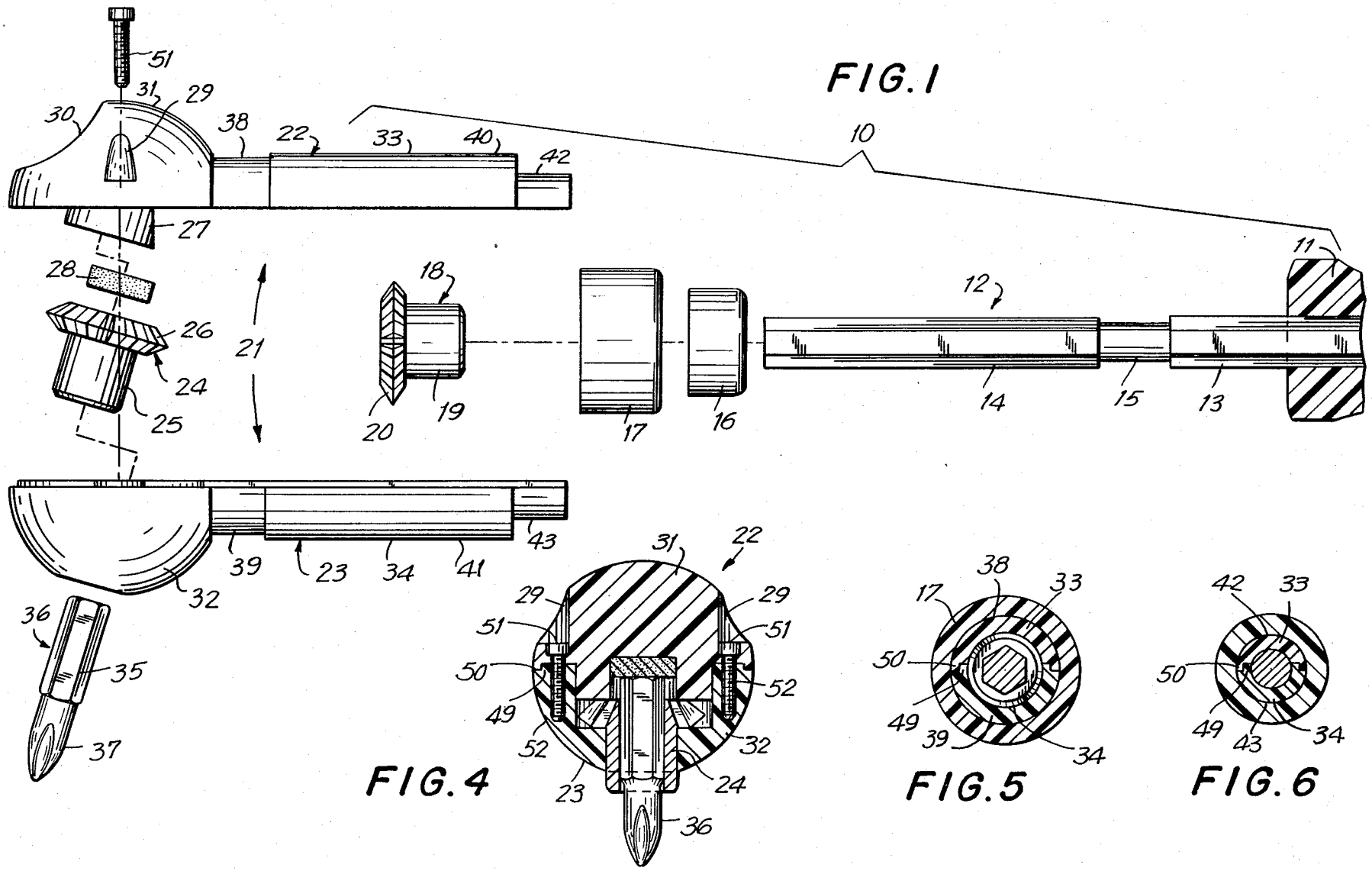
FIG. 1 is an exploded side elevational view of the gear driven offset screwdriver according to the present invention, at an enlarged scale.
FIG. 4 is a cross-sectional view taken on line 4—4 of FIG. 3.
FIG. 5 is a cross-sectional view taken on line 5—5 of FIG. 3.
FIG. 6 is a cross-sectional view taken on line 6—6 of FIG. 3.

Referring now to the drawing in detail, and first to FIG. 1 thereof, it may be seen that the reference numeral 10 has been used therein to identify a gear driven offset screwdriver arrangement, which is constructed in accordance with the present invention, in its entirety. The arrangement 10 includes, as one of its main components, a handle 11. Another main component of the arrangement 10 is a shaft 12 which has two end portions 13 and 14, and an intermediate portion 15 situated between the end portions 13 and 14. As shown, both end portions 13 and 14 have non-circular cross-sectional configurations, especially hexagonal ones. As illustrated in the drawing, both end portions 13 and 14 have the same cross-sectional configuration, with the facets of the hexagonal end portions 13 and 14 being aligned with one another. On the other hand, the intermediate portion 15 has a cylindrical configuration, that is, a substantially circular cross section, to serve as a bearing portion for the shaft 12, as will be explained later.

The arrangement 10 further includes two holding rings 16 and 17 which, in the unassembled condition of the arrangement 10, can be arranged around the shaft end portion 13 with clearance, prior to the completion of the assembling operation. Preferably, but not necessarily, the holding ring 17 is so internally dimensioned with respect to the external diameter of the holding ring 16 that the latter can pass therethrough. The holding rings 16 and 17 are advantageously circularly tubular.

The end portion 13 of the shaft 12 is partially received and held in the handle 11 for joint turning therewith about the axis of the shaft 12. As shown, the end portion 13 has a part that is embedded in the handle 11. However, it will be appreciated that, as is well known in the tool manufacturing field, the handle 11 could be provided with a recess compatible in configuration with the end portion 13, and the aforementioned part of the end portion 13 of the shaft 12 would then be merely inserted into this recess to be movable in the axial directions into and out of such recess, but to be entrained by the handle 11 for turning therewith about the longitudinal axis of the shaft 12. Such recess could then be bounded, at least along a part of the length thereof, by an insert of a rigid, preferably metallic, material embedded in the handle 11. Another part of the end portion 13 extends axially outwardly of the handle 11, and it is about this projecting part of the end portion 13 that the holding rings 16 and 17 are arranged in the partially assembled condition that has been referred to before.

A first bevel gear 18 having a sleeve-shaped mounting portion 19 and a bevel gear portion 20 is mounted on the end portion 14 of the shaft 12 in the partially and fully assembled condition of the arrangement 10 for joint rotation or turning with the shaft 12 about the longitudinal axis of the latter. To this end, the mounting portion 19 has a recess of a non-circular cross-sectional configuration compatible with or complementary to that of the shaft end portion 14, so that the latter will entrain the bevel gear 18 for joint turning therewith during the use of the assembly or arrangement 10. In the assembled condition of the arrangement 10, the bevel gear 18, together with other components of the arrangement 10 which are still to be described, is received in the interior of a housing 21 which is shown to consist of two separate shell-shaped sections 22 and 23. In the partially and fully assembled conditions of the arrangement 10, the shell-shaped sections 22 and 23 are brought together to constitute, in a manner still to be described, the housing 21, and are connected with one another by means of screws or similar fastening elements 51.

The other components of the arrangement 10 which are accommodated and supported in the interior of the housing 21 in the assembled condition of the latter include a second bevel gear 24 which is similar if not identical in construction to the first bevel gear 18, that is, it includes a mounting portion 25 which is provided with a non-circular, that is, again hexagonal, recess, and a bevel gear portion 26 which meshes with the bevel gear portion 20 of the bevel gear 18 in the assembled condition of the arrangement 10. The mounting portion 25 is supported for rotation but against any displacement transversely of the axis of rotation thereof in the shell-shaped housing section 23, in a manner yet to be described in more detail. The shell-shaped housing section 22 has a projection 27 that is provided with a recess capable of accommodating a magnetic member 28. The housing section 22 further includes, at its side that is visible in FIG. 1 as well as at the opposite, invisible side, a recess 29 for the respective screw 51. The housing section 22 also has a concave depression 30 at its region facing away from the handle 11 in the assembled condition.

Both housing sections 22 and 23 have generally semispherical end portions 31 and 32, and respective halfcylindrical tubular portions 33 and 34. The recesses 29 and the depression 30 are provided in the semi-spherical end portion 31 of the housing section 22 which also carries the projection 27. On the other hand, the semi-spherical end portion 32 of the shell-shaped housing section 23 is provided with the bearing for the mounting portion 25 of the bevel gear 24, and is provided with an opening that is in alignment with the non-circular recess of the mounting portion 25, through which a support portion 35 of a bit element 36 can be introduced into the interior of the assembled housing 21 to be substantially conformingly received in the recess of the mounting portion 25 and thus be entrained for joint rotation with the second bevel gear 24 about the axis of the latter which in this situation coincides with the longitudinal axis of the bit element 36. The bit element 36 further includes a bit portion 37 which is illustrated as a Phillips-type bit, but it will be appreciated that the bit portion could have any other desired configuration, such as Allen, Torx, flat for cooperation with slot-type screw heads, socket for cooperation with nuts or hexagonal, square or otherwise shaped screw heads, or any other desired configuration. As a matter of fact, a set of such bit elements 36, each with a different bit portion 37, may be provided with the arrangement 10, for use with differently shaped screw heads or nuts. Once the support portion 35 of the respective bit element 36 is fully inserted into the housing 21, that is, into the recess of the mounting portion 25, it is held in position against extraction by the magnetic forces originating in the magnetic member 28, in a manner yet to be described.

The semi-cylindrical tubular portions 33 and 34 include several regions of different external radii which are disposed next to one another in the axial direction, and are integral with the semi-spherical end portions 31 and 32, respectively. Such regions include, commencing at the respective semi-spherical end portions 31 and 32, reduced external radius regions 38 and 39, increased external regions 40 and 41, and substantially reduced external radius regions 42 and 43. In the fully assembled condition of the arrangement 10, the larger holding ring 17 is arranged around the reduced external radius regions 38 and 39, while the smaller holding ring 16 is arranged in juxtaposition with the substantially reduced external radius regions 42 and 43, after having been slid thereonto, to thereby hold the tubular portions 33 and 34 of the housing together.

This situation, that is, the fully assembled condition of the arrangement 10, is illustrated in FIG. 2. It may be seen therein that the external diameter of the smaller holding ring 16 substantially corresponds to twice the external radius of the increased external radius regions 40 and 41, so that the holding ring 16 forms a continuation of the latter. On the cther hand, the larger holding ring 17 is juxtaposed with the reduced external radius regions 38 and 39, thus obscuring the latter, and abuts the semi-spherical end portions 31 and 32 of the housing 21, as may best seen in FIG. 3. Of course, when it is desired to disassemble the housing 21, the holding rings 16 and 17 can be slid off of the semi-tubular portions 22 and 23 into juxtaposition of the part of the end portion 13 of the shaft 12 which projects out of the handle 11.

As also shown in FIG. 3, the substantially reduced external radius regions 42 and 43 also have a significantly reduced internal radius, so that they extend into contact with the cylindrical intermediate portion 15 of the shaft 12, thus constituting a bearing for the latter. On the other hand, the hexagonal end portion 14 is received in the interior of the housing 21 with a substantial clearance, so that there will be no interference by the housing 21 with the turning of the shaft 12 about its longitudinal axis. The mounting portion 19 of the bevel gear 18, however, is so dimensioned that the internal surface of the housing 21 is in a sliding contact therewith, thus constituting another bearing. Hence, it may be seen that the shaft 12 is supported in the housing 21 in two sliding bearings, in one instance at the intermediate portion 15 thereof, and in the other instance at the free end of the end portion 14 thereof via the mounting portion 19 of the bevel gear 18. The gear portion 20 of the bevel gear 18 is received, with freedom of rotation about the axis of the shaft 12 but only with a very limited, if any, freedom of displacement in the axial directions of the shaft 12, in a recess 44 of the housing 21. Since the shaft 12 itself is held against any significant displacement relative to the housing 21 in its axial directions by the sections 42 and 43 which extend into the groove constituted by the intermediate portion 15 of the shaft 12 between the end portions 13 and 14, there will be no, or no significant, displacement of either the shaft 12 or of the bevel gear 18 in the axial directions relative to the housing 21 and, therefore, relative to one another. Similarly, the bevel gear portion 26 of the second bevel gear 24 is confined between the projection 27 of the housing end portion 31 and a substantially planar surface 45 of the housing section 23, that is, of the semi-spherical housing end portion 32. The mounting portion 25 is received in the aforementioned opening through which the support portion 35 of the bit element 36 is introduced into the housing 21, this opening being denoted by the reference numeral 46. It may be seen that the opening 46 is dimensioned to receive the mounting portion 25 of the bevel gear 24 with substantially no clearance, so that the surface bounding the opening 46 serves as a radial bearing surface for the bevel gear 24, while the projection 27 constitutes an axial or thrust bearing for the bevel gear 24. The bevel gear portions 20 and 26 mesh with one another and, because of the axial immovability of each of the bevel gears 18 and 24, stay in such meshing engagement with each other. The mounting portion 25 of the bevel gear 24 extends outwardly beyond the housing 21.

The magnetic member 28 is received in a recess 47 of the projection 27 and is secured therein, for instance, by being glued therein, so that it cannot move in the axial directions of the bevel gear 24, the projection 27 preventing movement of the magnetic member 28 in the radial directions, in cooperation with the holding action of the glue or other adhesive substance. Of course, the magnetic member 28 could be held in position in the recess 47 by an interference fit. A bottom surface 48 of the recess 47 constitutes an axial thrust bearing surface for the magnetic member 28, so that the latter can serve as a thrust bearing for the bit element 36 during the use of the arrangement 10. The magnetic member 28 generates a magnetic field which holds the bit element 36, which is made of a magnetically attractable material, in position during the period of non-use of the arrangement 10. While the magnetic force is relatively weak, it ought to be realized that the forces acting on the bit element 36 during the period of nonuse and having a tendency to displace the bit element 36 away from the magnetic member 28 also have relatively small magnitudes, so that the magnetic forces will be sufficient to prevent the bit element from falling out of the interior of the mounting portion 25 of the bevel gear 24 except under most severe conditions which occur only rarely, if ever. On the other hand, such magnetic forces can be overcome relatively easily by the user of the arrangement 10 when it is desired to dissociate the bit element 36 from the remainder of the arrangement 10, for instance, for replacement purposes. The user then only has to exert a relatively small axial force on the bit element 36, for instance, by gripping the bit portion 37 and pulling on it, to remove the bit element 36.

The axis of the bevel gear 24, which coincides with that of the bit element 36, includes an obtuse angle with the axis of the bevel gear 18 which coincides with the axis of the shaft 12. This obtuse angle is shown to be about 105°, but it may be anywhere in a range of angles, such range preferably extending between 100° and 135° inclusive. This expedient achieves the advantage that, during the use of the arrangement 10, while the axis of the bit element 36 will extend substantially normal to a surface of a structure, the axis of the shaft 12 will diverge from this surface with increasing distance from the bit element 36, so that sufficient space will be available at the handle 11 to manipulate the arrangement 10 during its use, that is basically to turn the shaft 12 about its longitudinal axis by means of the handle 11. Moreover, because of such divergence, sufficient room will also be available around the housing 21 at least at the region of the holding ring 16 for the user to get a secure grip of the housing 21 during such use. The user then may, and usually will, position one finger in the depression or finger notch 30 to assure proper control of the position of the bit element 36. FIG. 3 also illustrates that the housing sections 22 and 23 are provided with associated ridges or tongues 49 and 50 which are interengaged once the housing sections 22 and 23 are brought together during the assembly of the arrangement 10. The interengagement of the ridges 49 assures proper positioning of the housing sections 22 and 23 with respect to one another prior to the slipping of the holding rings 16 and 17 onto the semi-tubular sections 33 and 34, thus avoiding any problems or interferences with this slipping-on action.

As shown in FIGS. 4 to 6, the ridges 49 and 50 extend all around the shell-shaped housing sections 22 and 23, that is, around the semi-spherical end portions 31 and 32, as well as at least along the semi-tubular portions 33 and 34. FIG. 4 also shows that the threaded connecting elements 51 are threaded into corresponding bores 52 of the housing end portion 32, while their heads are accessibly received in the recesses 29 of the housing end portion 31. As shown, the heads of the screws 51 are further recessed or sunk in the recesses 29, but this is only currently preferred, not mandatory. It may be seen in FIG. 5 that the holding ring 17 indeed tightly embraces the sections or regions 38 and 39 of the semi-tubular housing sections 33 and 34 to hold the same together against falling apart in the radial directions, while FIG. 5 illustrates that the holding ring 16 accomplishes the same function at the regions 42 and 43 of the housing sections 33 and 34, thus holding the housing together in the fully assembled condition of the latter.

Finally, FIG. 7 of the drawing depicts a modification of the housing sections 22 and 23 which take the place of the interengaging ridges 49 and 50. Herein, there is being used at least one locating finger 53, but preferably a plurality of such fingers 53, which cooperates with a counterpart 54, such as another er finger or a ridge. At least one of the fingers or formations 53 and 54 is provided with a ramp surface 55 which facilitates assembly and positioning of the housing sections 22 and 23.

It will be understood that each of the elements described above, or two or more together, may also find a useful application in other types of arrangements differing from the type described above.

While the invention has been illustrated and described as embodied in a hand tool with a Phillips-type bit element, it is not intended to be locted to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims. What is claimed as new and desired to be protected by Letters Patent is set forth in the appended claims:

I claim:

1. A bevel gear driven offset screwdriver arrangement, comprising:

(A) a housing including two separate half-shell elements assembleable in an assembled condition to bound an internal space, said assembled elements surrounding an elongated passage centered on a first axis and having end portions surrounding an opening that communicates with the passage and that is centered on a second axis that includes an obtuse angle of between substantially 100° and 135° with the first axis, said housing having first, second and third tubular regions respectively having first, second and third exterior circular walls arranged next to one another along the passage, said third circular wall having a larger exterior diameter than said first circular wall;

(B) a shaft extending through and beyond the passage and mounted on the housing for rotation about the first axis;

(C) a handle operatively connected to the shaft for rotating the shaft about the first axis;

(D) means for holding the half-shell elements together in the assembled condition, including a smaller and a larger holding ring having smaller and larger interior circular walls respectively, said smaller and larger interior circular walls having smaller and larger diameters respectively corresponding to said first and third exterior circular walls of the elements, (i) said smaller interior circular wall of the smaller holding ring circumferentially and tightly engaging the first exterior circular wall of the assembled elements, and for circumferentially holding the half-shell elements together in the assembled condition at one holding zone on the first axis, (ii) said larger interior circular wall of the larger holding ring circumferentially and tightly engaging the third exterior circular wall of the assembled elements, and for circumferentially holding the half-shell elements together in the assembled condition at another holding zone on the first axis;

(E) a first bevel gear mounted on the shaft for rotation within the housing about the first axis therewith at a region close to the opening;

(F) a second bevel gear mounted in the opening for rotation within the end portions about the second axis and meshing with the first bevel gear in the internal space of the housing, said second bevel gear having a coaxial central recess of a non-circular configuration;

(G) a bit element having a bit portion of a predetermined configuration compatible with that of a threaded element to be manipulated, and a support portion of a cross-sectional configuration compatible with that of the recess of the second bevel gear for the support portion to be received in the latter and entrained for joint rotation with the second bevel gear during the operation of the arrangement in response to the rotation of the first bevel gear with the shaft and the handle, said support portion of the bit element being of a magnetically attractable material and having a bearing surface; and (H) means for retaining the support portion in the central recess of the second bevel gear against falling out of the latter during periods of non-use of the arrangement, including a permanent magnet mounted in the housing in alignment with the second gear and attracting the support portion of the bit element with a magnetic force that is sufficient to keep the support portion in the central recess until overcome by the user of the arrangement during disassembly of the bit element from the remainder of the arrangement, said magnet having an axial thrust surface against which the bearing surface of the bit element journalably bears during rotation of the bit element relative to the magnet.

2. The arrangement as defined in claim 1, wherein said obtuse angle is substantially 105°.

3. The arrangement as defined in claim 1, wherein the end portions are semi-spherical and are integral with the tubular regions.

4. The arrangement as defined in claim 3; and further comprising a depression formed in one of the end portions and in which a user may position a finger.

5. The arrangement as defined in claim 1, wherein the half-shell elements have ridges which interengage one another in the assembled condition.

* * * * *